US007231795B2

(12) United States Patent
Ghezzi

(10) Patent No.: US 7,231,795 B2
(45) Date of Patent: Jun. 19, 2007

(54) AUTOMATIC ROLLING MACHINE WITH FLAT CHASERS

(75) Inventor: Enrico Ghezzi, Tortona (IT)

(73) Assignee: S.M.A.R.T., S.R.L., Tortona (IT)

( * ) Notice: Subject to any disclaimer, the term of this patent is extended or adjusted under 35 U.S.C. 154(b) by 98 days.

(21) Appl. No.: 10/514,950

(22) PCT Filed: May 26, 2003

(86) PCT No.: PCT/EP03/05460

§ 371 (c)(1),
(2), (4) Date: Apr. 18, 2005

(87) PCT Pub. No.: WO03/099488

PCT Pub. Date: Dec. 4, 2003

(65) Prior Publication Data

US 2006/0059968 A1 Mar. 23, 2006

(30) Foreign Application Priority Data

May 28, 2002 (IT) ..... MI2002A1145

(51) Int. Cl.
*B21H 1/18* (2006.01)
*B21H 3/06* (2006.01)

(52) U.S. Cl. ..... 72/90

(58) Field of Classification Search ..... 72/88, 72/90, 469
See application file for complete search history.

(56) References Cited

U.S. PATENT DOCUMENTS

| | | | | |
|---|---|---|---|---|
| 1,108,425 | A | 8/1914 | Brennan et al. | |
| 3,839,891 | A | 10/1974 | Grohoski | |
| 5,345,800 | A | 9/1994 | Smith et al. | |
| 5,555,757 | A * | 9/1996 | Smith et al. | 72/88 |
| 5,560,238 | A * | 10/1996 | Allebach et al. | 72/13.4 |

FOREIGN PATENT DOCUMENTS

| | | | |
|---|---|---|---|
| GB | 606439 | A | 8/1948 |

* cited by examiner

*Primary Examiner*—Daniel C. Crane
(74) *Attorney, Agent, or Firm*—R. Neil Sudol; Henry D. Coleman; William J. Sapone

(57) ABSTRACT

An automatic rolling machine with flat chasers, comprising a motionless plate and a movable plate. The movable plate is fixed to a supporting structure that has a reciprocating motion actuated by means of a spindle, crank and linkage, the spindle being supported by a base. The base comprises a first motionless part, which is rigidly coupled to the frame of the machine, and a second movable part, which constitutes the support for the spindle, the position of the movable part with respect to the motionless part being adjustable by a means for varying the position of the movable part with respect to the motionless part.

4 Claims, 3 Drawing Sheets

AUTOMATIC ROLLING MACHINE WITH FLAT CHASERS

BACKGROUND OF THE INVENTION

This application is a 371 of PCT/EP03/05460, filed May 26, 2003.

The present invention relates to an automatic rolling machine with flat chasers.

Rolling machines that generate the thread by cold rolling can be used to produce screws.

In a machine of this type, the blank is placed between two plates, one of which is motionless while the other can perform a reciprocating motion, and the plates roll the blank under pressure.

Since the plates have protrusions that are inclined at the angle that corresponds to the pitch of the thread to be formed, they constitute a female thread spread flat, and by pressing the material they force it to assume the shape of the thread.

The ever-shrinking size of production batches on the part of screw manufacturers, together with the persistent difficulty in finding specialized personnel capable of working with a sufficient level of skill, have led to the need to provide machines that are functionally as simple as possible, i.e., have a very high degree of automation.

The aim of the present invention is to provide an automatic rolling machine with flat chasers that is improved over currently available machines.

OBJECTS OF THE INVENTION

A particular object of the invention is to provide a machine whose geometry can be changed easily in order to be able to use tools, i.e., the flat chasers, of different sizes, so as to make the use of the rolling machine particularly flexible, allowing to use it to replace machines of different sizes.

Another object of the invention is to provide a machine that is particularly advantageous for users that produce special rolled parts, with the need to use multipart chasers.

Another object is to provide a machine with easier setup and to avoid in particular manual intervention on the big end of the linkage, which in addition to its objective difficulties sometimes entails a certain risk.

This aim and these and other objects that will become better apparent hereinafter are achieved by an automatic rolling machine with flat chasers, comprising a motionless plate, a movable plate fixed to a supporting structure having a reciprocating motion, a base and means for actuating the reciprocating motion, the means for actuating comprising a spindle, a crank, and a linkage, the spindle being supported by the base and actuating the crank, the crank in turn actuating the reciprocating motion of the supporting structure of the movable part by means of the linkage, wherein the base comprises a first motionless part, which is rigidly coupled to the frame of the machine, and a second movable part, which constitutes the support of the spindle, the position of the movable part with respect to the motionless part being adjustable by a means for varying the stroke of the movable part with respect to the motionless part.

BRIEF DESCRIPTION OF THE DRAWINGS

Further characteristics and advantages of the present invention will become better apparent from the description of preferred but not exclusive embodiments thereof, illustrated by way of non-limitative example in the accompanying drawings, wherein.

DETAILED DESCRIPTION OF PREFERRED EMBODIMENTS

Figure 1:
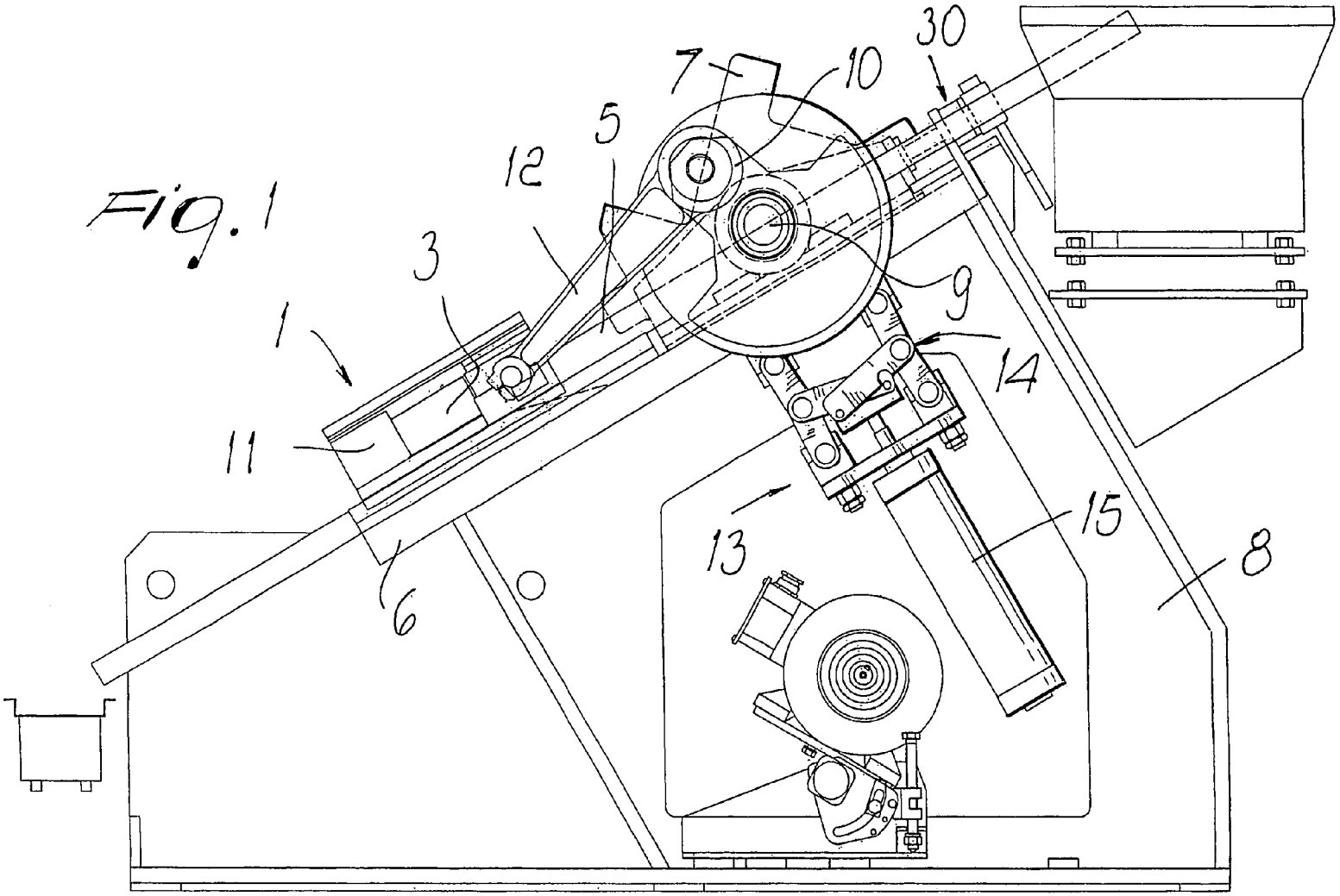
FIG. 1 is a schematic side elevation view of the rolling machine according to the invention.
Figure 2:
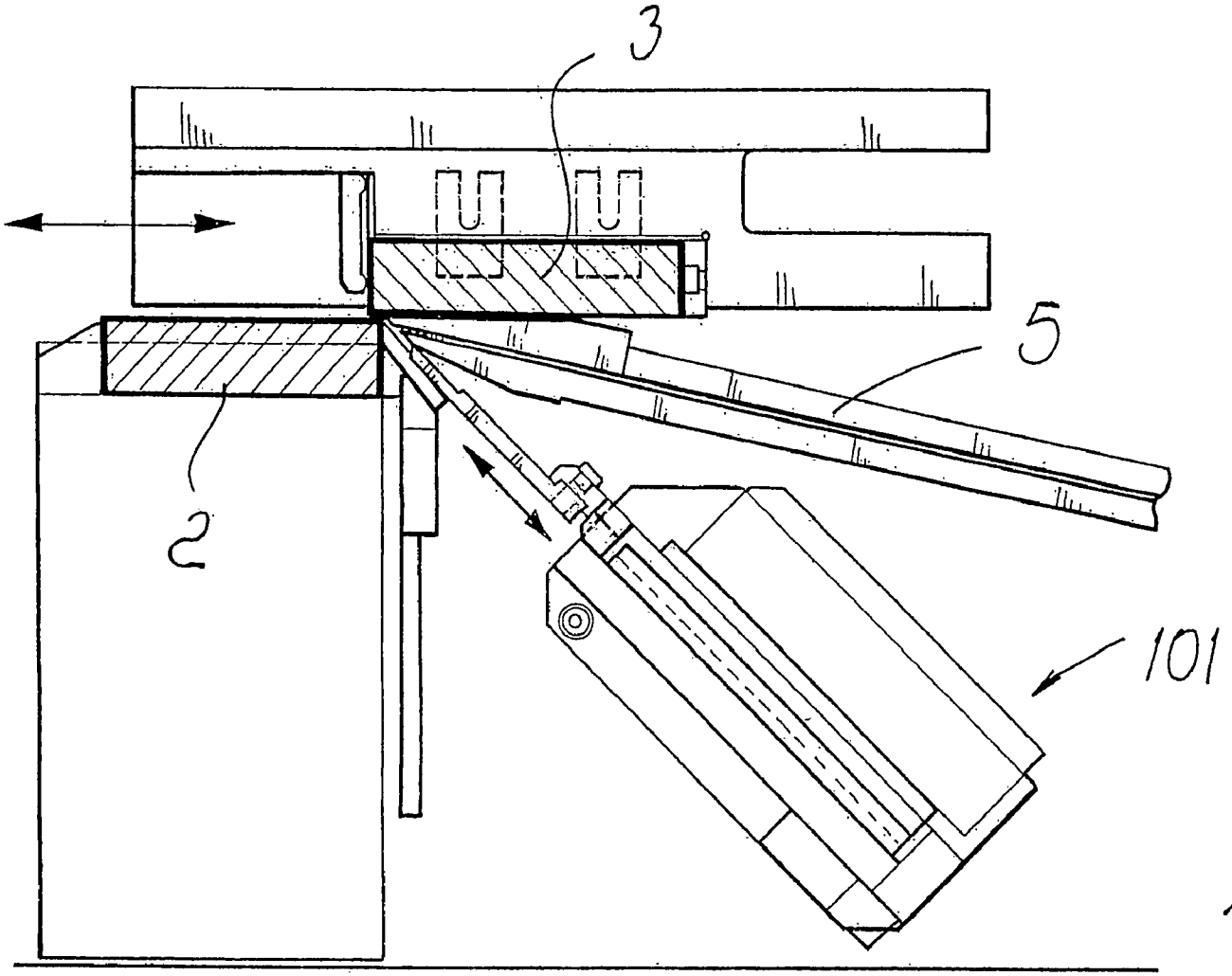
FIG. 2 is a schematic plan view of the insertion region of the rolling machine according to the invention.
Figure 3:
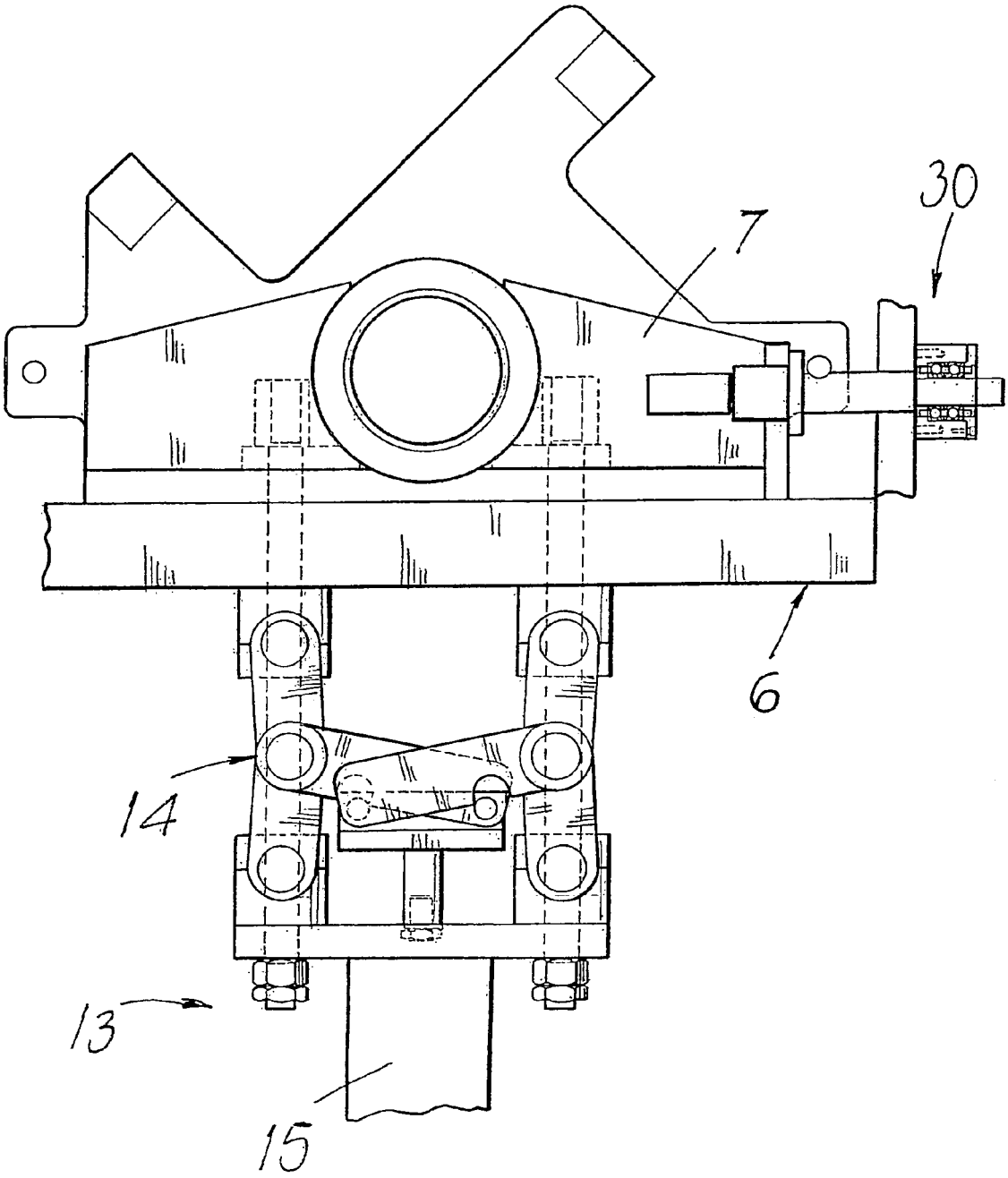
FIG. 3 is an enlarged-scale side elevation view, which illustrates in greater detail the means for varying the stroke of the movable part of the base.

With reference to the cited figures, the rolling machine according to the invention, generally designated by the reference numeral 1, essentially comprises a motionless plate 2 and a movable plate 3, which has a reciprocating motion.

A blank, arriving from a feeder guide 5, is placed by an insertion device 101 between the two plates 2 and 3, which roll it under pressure.

The plates have protrusions that are inclined at an angle that corresponds to the pitch of the thread, thus constituting a female thread spread flat, and by pressing the material they force it to assume the shape of the thread.

According to the invention, the machine comprises a base that is essentially composed of two parts: a first part 6, which constitutes the actual base and is rigidly coupled to a frame 8 of the machine, and a second movable part 7, which constitutes the support of a spindle 9.

The spindle 9 actuates a crank 10, which in turn actuates the reciprocating motion of a support 11 of the movable plate 3 by means of a linkage 12 in a per se known manner.

The position of the movable part 7 with respect to the fixed part 6 of the base can be adjusted by a means for varying the position, which is generally designated by the reference numeral 30 and comprises an actuator that is constituted for example by a ballscrew and by a gearmotor.

The locking of the movable part 7 at the end of the adjustment is obtained by means of a toggle system 14 actuated by an actuator 15 that is constituted for example by a pneumatic cylinder.

The splitting of the base, which is traditionally formed by a single structure, together with the manual action on the crank button, allows to adapt the geometry of the machine in order to be able to use tools, i.e., flat chasers, of different sizes, for example from the WF 10 standard to the WF 20 standard, so as to allow a particularly flexible use of the rolling machine, which can be used instead of machines of different sizes.

This opportunity is particularly advantageous if one wishes to produce special rolled parts, where it is necessary to use multipart chasers.

The machine according to the invention, moreover, facilitates setup, avoiding in particular manual intervention on the big end of the linkage, which in addition to its objective difficulties sometimes entails a certain risk.

Also, the machine according to the present invention allows easy automation, which cannot be applied as simply to the conventional adjustment of the timing on the big end of the linkage.

In practice it has been found that the invention achieves the intended aim and objects, a rolling machine being provided whose geometry can be changed easily in order to be able to use tools, i.e., flat chasers, of different sizes.

The machine according to the invention is particularly flexible in use and can be used instead of machines of different sizes.

The particular split structure of the supporting base, moreover, facilitates overall strength and precision in construction, which together with an appropriate choice of the materials ensure total stability of the operating conditions of the machine.

The machine according to the invention is susceptible of numerous modifications and variations, within the scope of the appended claims. All the details may be replaced with technically equivalent elements.

The materials used, as well as the dimensions, may of course be any according to requirements and to the state of the art.

What is claimed is:

1. An automatic rolling machine with flat chasers, comprising a motionless plate, a movable plate fixed to a supporting structure having a reciprocating motion, a base and means for actuating said reciprocating motion, said means for actuating comprising a spindle, a crank, and a linkage, said spindle being supported by said base and actuating said crank, said crank in turn actuating said reciprocating motion of said supporting structure of said movable part by means of said linkage, wherein said base comprises a first motionless part, which is rigidly coupled to the frame of the machine, and a second movable part, which constitutes the support of the spindle, the position of said movable part with respect to said motionless part being adjustable by a means for varying the position of the movable part with respect to the motionless part.

2. The machine according to claim 1, wherein the means for varying the position of the movable part comprises a device with a ballscrew and gearmotor.

3. The machine according to claim 2, wherein the means for varying the position of the movable part comprises a device for locking the movable part in the preset position, said device comprising a toggle system actuated by an actuator.

4. The machine according to claim 3, wherein said actuator comprises a pneumatic cylinder.

* * * * *